US007675463B2

(12) United States Patent
Wallace et al.

(10) Patent No.: US 7,675,463 B2
(45) Date of Patent: Mar. 9, 2010

(54) MINIATURIZED INTEGRATED MONOPOLE ANTENNA

(75) Inventors: Richard Wallace, Jaerfaella (SE); Are Bjorneklett, Vaesteras (SE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 11/522,097

(22) Filed: Sep. 15, 2006

(65) Prior Publication Data

US 2007/0103373 A1 May 10, 2007

(30) Foreign Application Priority Data

Sep. 15, 2005 (EP) ..... 05020115

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/700 MS
See application file for complete search history.

(56) References Cited

U.S. PATENT DOCUMENTS

| | | | | |
|---|---|---|---|---|
| 3,568,206 | A * | 3/1971 | Sisson et al. | 343/750 |
| 6,353,443 | B1 | 3/2002 | Ying | |
| 6,362,784 | B1 * | 3/2002 | Kane et al. | 343/700 MS |
| 6,535,166 | B1 | 3/2003 | Alil | |
| 6,894,646 | B2 * | 5/2005 | Washiro et al. | 343/700 MS |
| 6,930,640 | B2 * | 8/2005 | Chung et al. | 343/700 MS |
| 2002/0140081 | A1 | 10/2002 | Chou et al. | |
| 2003/0156065 | A1 * | 8/2003 | Jo et al. | 343/700 MS |

FOREIGN PATENT DOCUMENTS

| | | | |
|---|---|---|---|
| EP | 0938158 | A | 8/1999 |
| JP | 2002 026624 | A | 1/2001 |
| WO | WO 00/03453 | | 1/2000 |
| WO | WO 01/06596 | | 1/2001 |
| WO | WO 01/37437 | | 5/2001 |
| WO | WO 01/78354 | A2 | 10/2001 |
| WO | WO 02/067375 | A1 | 8/2002 |
| WO | WO 02/095870 | | 11/2002 |
| WO | WO03/010796 | A2 | 2/2003 |
| WO | WO 03/061065 | | 7/2003 |

* cited by examiner

*Primary Examiner*—Trinh V Dinh
(74) *Attorney, Agent, or Firm*—Maginot, Moore & Beck

(57) ABSTRACT

The invention is related to a monopole antenna provided for short-range applications, having a conductive pattern arranged on a dielectric substrate. The conductive pattern has a first straight radiating element connected to an antenna feeding point, a second straight radiating element arranged essentially parallel to the first radiating element and interconnected to it, and further a third straight radiating element arranged between the first and second radiating elements and essentially parallel to both of the first and second radiating elements and interconnected to the second radiating element. The electric and magnetic fields of the first and the third radiating elements are thereby interacting constructively. The invention is also related to an integrated circuit having such monopole antenna, and a method for manufacturing such monopole antenna.

17 Claims, 3 Drawing Sheets

MINIATURIZED INTEGRATED MONOPOLE ANTENNA

CROSS-REFERENCE TO RELATED APPLICATION

This application claims priority from European Patent Application No. 05020115.1, which was filed on Sep. 15, 2005, and is incorporated herein by reference in its entirety.

BACKGROUND

The present invention is related to the field of antennas, and more particularly to a monopole antenna provided for short-range applications, and comprising an electrically conductive pattern arranged on a dielectric substrate.

In the ever-increasing use and development of wireless communication, the demand for small and compact portable devices is likewise increasing. The miniaturization is possible owing to the rapidly reducing physical size and cost of wireless electronic components, this in turn enabled by the progress and technological improvements made in microelectronic technologies, such as semiconductors, packaging and interconnection technologies.

Antennas constitute a crucial part of such wireless communication system, but have not been subject to a corresponding cost and size reduction. The physical size of an antenna is not as much related to the improvements of the manufacturing methods used, as to the operating frequency or wavelength of the system in which it is to be used. Accordingly, as portable devices, such as mobile phones, become smaller and smaller, new requirements are placed on miniaturizing the antennas to be used with such devices as well. However, making antennas smaller include several challenges, as the performance of the antenna should not be allowed to decrease. The cost of the antenna is also a very important consideration, especially in short-range wireless communication devices.

Classical antenna structures such as monopoles and dipoles are fabricated using dedicated structural components such as wires, tubes and mechanical support. This is an expensive manufacturing method and would add far too much cost to equipment for short-range wireless communication applications, such as Bluetooth enabled equipment, in order to be feasible.

For short-range antennas to be cost-effective, they are instead manufactured by high volume, low cost manufacturing technologies similar to the methods used for manufacturing the microelectronic components themselves. Examples of such manufacturing technologies include ceramic multilayer antennas and printed antennas, that is, antennas made by PCB (Printed Circuit Board) technology.

There are integrated antennas available, for example patch antennas and microstrip antennas manufactured by PCB, ceramic technologies or by utilising special low dielectric materials. Such antennas, although having a relatively low cost, have a physical height much exceeding current requirements.

Even the classical antenna configurations monopole and dipole antennas may be manufactured by printed circuit board techniques. However, the operating frequency of the antenna should be so high that the physical size of the antenna is reasonable with respect to the manufacturing technology. This gives a physical size of the antenna many times bigger than the size of the radio component itself, which is of course unacceptably large.

A type of antenna resembling a printed monopole antenna is a printed inverted F antenna (PIFA), the physical size of which is somewhat smaller, but still very big compared to the typical component size.

Still another type of antenna typically made by PCB technology is a loop antenna. The physical size of a loop antenna can be reduced by introducing additional components, such as capacitors, but at the expense of reduced performance. Besides the additional space required, the addition of components also adds time to the manufacturing process, and entails another possible source of failure. Further, the radiation efficiency of loop antennas is rather low.

Still another type of antenna is a fractal antenna, first described about a decade ago. It is based on so-called fractal geometries, or geometrical patterns repeating itself in smaller and smaller size. The major advantage of fractal antennas is their ability to operate on a wide range of frequencies, and it is also possible to design compact fractal antenna structures. However, the fractal geometrical patterns are often very complex and can therefore be difficult to manufacture with high precision.

Thus, all the above described antenna types entail shortcomings regarding their suitability to be miniaturised as well as to be easily integrated, and it would therefore be desired to provide an antenna structure overcoming these difficulties.

BRIEF SUMMARY

It is an advantage of the at least some embodiments of the present invention to provide an antenna structure suitable for miniaturisation and integration with an electronic component.

It is another advantage of some embodiments to provide an antenna structure enabling a simple manufacturing of antennas, and in particular enabling a low cost manufacturing in which an antenna constitutes a physical part of an electronic component.

It is a further advantage to provide an antenna structure providing a small-sized antenna suitable for short-range, relatively low-power applications, such as Bluetooth™.

In accordance with a first embodiment of the present invention there is provided a monopole antenna for short-range applications, comprising an electrically conductive pattern arranged on a dielectric substrate. The conductive pattern comprises a first straight radiating element connected to an antenna feeding point. A second straight radiating element is arranged essentially parallel to the first radiating element and interconnected to it, and a third straight radiating element is arranged between the first and second radiating elements essentially parallel to both of said first and second radiating elements and interconnected to the second radiating element. By means of this configuration the electromagnetic fields of the first and the third radiating elements is not cancelling each other out, thereby providing an antenna with increased performance compared to state of the art miniaturized antennas. Further, by means of the invention an integrated circuit for radio communication including the inventive, simple antenna structure can be easily manufactured, substantially lowering the manufacturing costs. The size of the antenna can be made very small compared to the operating wavelength of the antenna, thus providing a very small-sized antenna for use in portable devices.

In accordance with one embodiment of the invention the third radiating element is the open end of the monopole antenna. A short antenna is thus accomplished having only three straight radiating segments and thereby having a favourable structure rendering it suitable for mass production.

In accordance with another embodiment of the invention the length of each of the radiating elements is approximately a twentieth of an operating wavelength of the antenna. Owing to the structure of the radiating pattern, this miniaturising is possible without any essential decrease of the antenna performance.

In accordance with yet another embodiment of the invention the distance between the first and third radiating elements is less than the distance between the second and third radiating elements. The constructive interaction between the electromagnetic fields of the first and third radiating elements is thereby maximized, while at the same time the counteracting fields of the third and second radiating elements is minimised. In an alternative embodiment these distances are equal, thus giving design flexibility and providing alternative layout possibilities, for example in dependence on available space.

In accordance with still another embodiment of the invention the length of a radiating element is substantially longer than the distances between the radiating elements. The external physical dimensions of the antenna may thereby be fitted in a very small space, rendering the antenna well suited for being incorporated in mobile devices, such as cellular phones or the like.

In accordance with yet another embodiment of the invention the radiating elements are interconnected by means of curved or straight interconnecting parts. This again adds to the design flexibility of the antenna, the designer being able to chose a suitable layout for example in dependence on the available space.

In accordance with still another embodiment of the invention the first radiating element is also provided with an electrical ground connection. This embodiment may be advantageous in many cases for achieving a better matching between the antenna and an electronic component with which the antenna is to operate.

In accordance with yet another embodiment of the invention the radiating elements constitute a single continuous structure. Such structure may be produced by any suitable technique, such as etching or printing.

In accordance with still another embodiment of the invention the short-range application in which the antenna is to operate is Bluetooth having an operating frequency of approximately 2.45 GHz. The radiation efficiency of the antenna according to the invention is well suited for adaptation to a Bluetooth application, giving a length of each of the radiating elements of approximately 6 mm. The cost of manufacturing such antennas is reasonable for such short-range applications.

The invention is also related to an integrated circuit comprising such a monopole antenna integrated in the circuit, whereby advantages similar to the above described are achieved. A very simple and cost-effective manufacturing of an integrated circuit for communication purposes, such as for example a transceiver circuit, may thereby be implemented.

The invention is further related to a method for manufacturing such monopole antenna, whereby similar advantages are achieved.

BRIEF DESCRIPTION OF THE SEVERAL VIEWS OF THE DRAWING(S)

Further characteristics of the invention, and advantages thereof, will be evident from the following detailed description of embodiments of the present invention and the accompanying FIGS. 1-7, which are given by way of illustration only and are not to be construed as limitative of the invention.

DETAILED DESCRIPTION

A most interesting manufacturing method for transceiver circuits would be to integrate the antenna with the microelectronic component itself. A meander antenna could be an interesting alternative for such integration with an integrated circuit. The basic principle of this type of antennas is to curl the conducting structures needed for a proper antenna into a smaller area. The physical size of the antenna can be reduced considerably, but the operating performance will however always be degraded; it is not possible to miniaturise an antenna just by folding radiating elements into any configuration and expect to obtain the desired characteristics. The design of equipment requiring interconnection of radio components and antennas is often difficult and requires extensive knowledge in radio technology.

Figure 1:
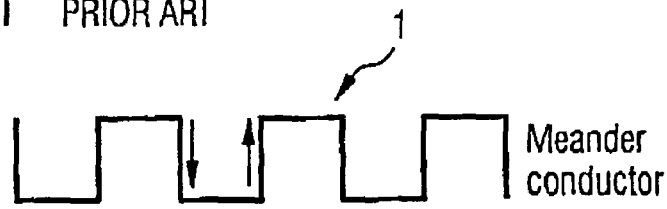
FIG 1 PRIOR ART
FIG. 1 illustrates the principle of a meander antenna structure.

With reference to FIG. 1 a typical meander antenna structure is shown. A straight conductor is folded into a curved structure or a meander antenna 1. Thereby a substantially longer antenna, usually more than twice the length of the straight conductor, is obtained without necessitating a corresponding increase in size, thereby achieving a space saving. However, as briefly mentioned above, this cannot be done without degrading the antenna performance, for example in terms of radiation efficiency, due to, among other things, interfering electromagnetic fields in adjacent conductor segments. As indicated by the arrows in the figure, the electrical current in adjacent conductor segments of the meander antenna will be in opposite directions. The electric and magnetic fields generated by the currents in the adjacent conducting segments will thus be in opposite directions and will therefore tend to cancel out. The resistance of the antenna structure increases when trying to miniaturize an antenna, and constitutes a major source of losses.

In the present invention such a meander antenna has been used as a starting point in an effort to provide a physically short antenna suitable primarily for mobile short-range and low power applications, such as Bluetooth operating at 2.5 GHz. Other examples of short-range, low power applications in which the present invention may be advantageously utilised are in applications utilising the Industrial, Scientific and Medical (ISM) radio bands. To fold an antenna will reduce its effectiveness and makes theoretical analysis extremely difficult. Simulations for such a meander antenna were performed and showed that the performance of the antenna was not as high as would be desired and the losses were too extensive.

In accordance with the present invention, an antenna structure overcoming, or at least reducing the cancellation problems described above is provided. The inventive antenna structure yields a higher radiation efficiency compared to the meander antenna and is a very small-sized antenna. The radiation efficiency is not sufficient for long-range applications, such as GSM or the like, but shows a very adequate performance for short range (up to about 100 meters) and low power (up to about 100 mW) applications, such as Bluetooth. Further, the structure is simple, i.e. not involving complicated patterns as in the case of for example fractal antennas. The inventive antenna structure is therefore well suited for mass production, that is, high volume low cost manufacturing technologies, such as printed circuit board technology, ceramic thick film technology, ceramic multilayer technology (e.g. LTCC) and flexible circuit technology, including for example polyimide or polyester materials. The manufacturing costs may be greatly reduced, and the antenna may even be integrated on-chip with and manufactured simultaneously with an electronic component intended for wireless communication, such as a transceiver, or either part of a transceiver, i.e. a receiver or a transmitter.

Figure 2:
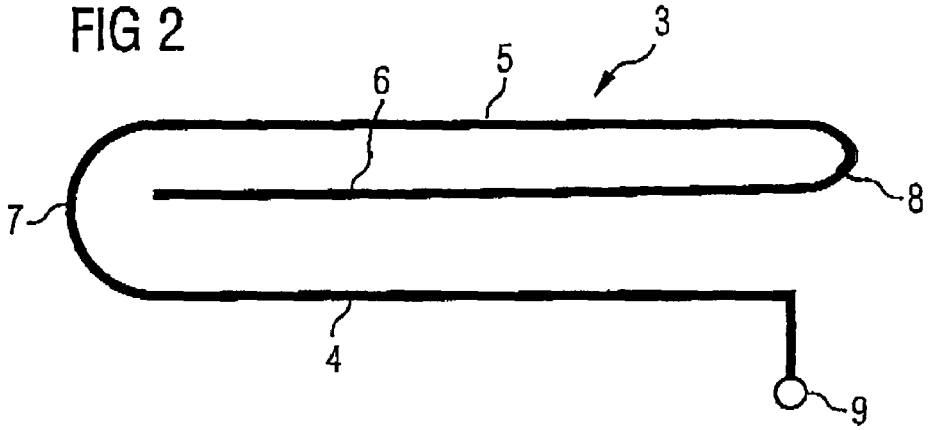
FIGS. 2 and 3 are embodiments of the antenna in accordance with the present invention.

With reference to FIG. 2 a first embodiment of such antenna structure is shown. The antenna structure comprises three straight, or linear, radiating elements 4, 5 and 6. The first radiating element 4 is connected to an antenna feeding point 9 and connected to the second radiating element 5 at its other end by means of an interconnecting part 7. The second radiating element 5 is similarly interconnected by means of a second interconnecting part 8 to the third radiating element 8. The interconnecting parts 7, 8 may be short curved or straight traces, or even a combination of those (not shown). By this innovative configuration, the performance of the antenna may be greatly increased, but not at the expense of making it larger. In an embodiment the third radiating element 6 is the open end of the antenna, making the conductive pattern very small.

Figure 3:
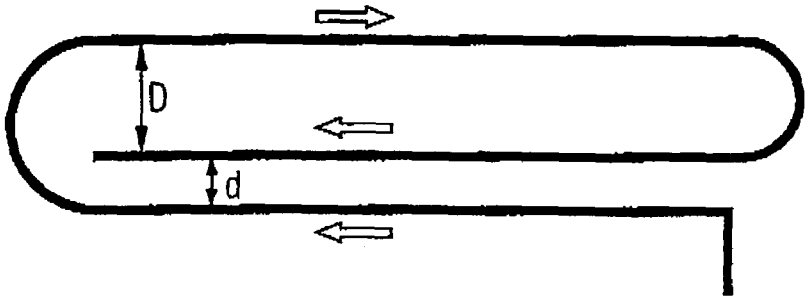

With reference now to FIG. 3, the conductive segments or radiating elements 4, 5, 6 are interconnected in such a way that the cancellation of electromagnetic fields due to opposite currents is minimized. The arrows indicate the current directions, and the electric and magnetic fields created by the first 4 and the third radiating elements 6 are interacting constructively, whereby the cancellation effects problematic of existing meander antennas are greatly reduced. The distance d between the first radiating element 4 and the third radiating element 6 is preferably smaller than the distance D between the second radiating element 5 and the third radiating element 6 in order to obtain such minimization. An embodiment in which D=d is however possible, in some cases at the expense of a somewhat decreased antenna performance. In an embodiment D is much larger than d, the ratio D/d being as large as possible, for example as large as the manufacturing process admits.

Figure 4:
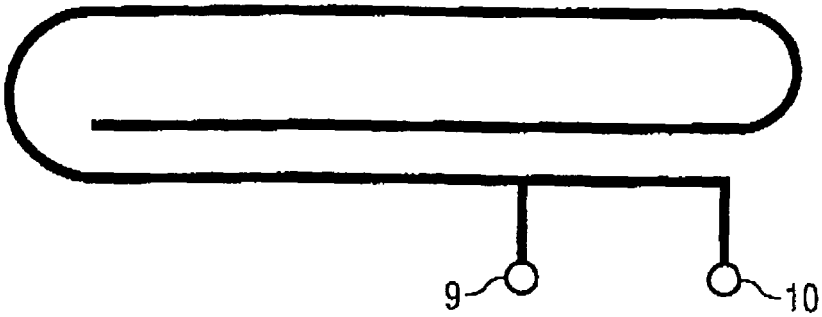
FIG. 4 is another embodiment of the antenna in accordance with the present invention.

FIG. 4 shows another embodiment of the invention. The antenna may be provided with an electrical ground connection 10 besides the antenna feeding connection 9. A better matching between the antenna and the electronic component with which the antenna is to be used is thus accomplished, as is known within the field.

Figure 5:
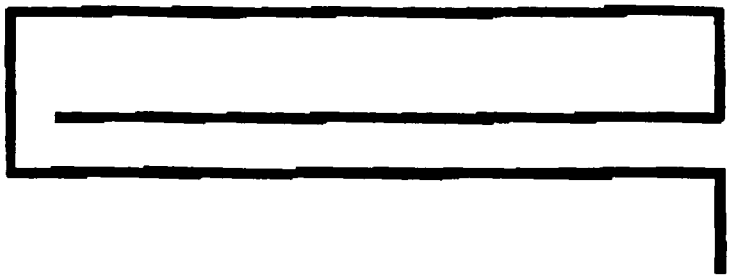
FIG. 5 is yet another embodiment of the antenna in accordance with the present invention.
Figure 6:
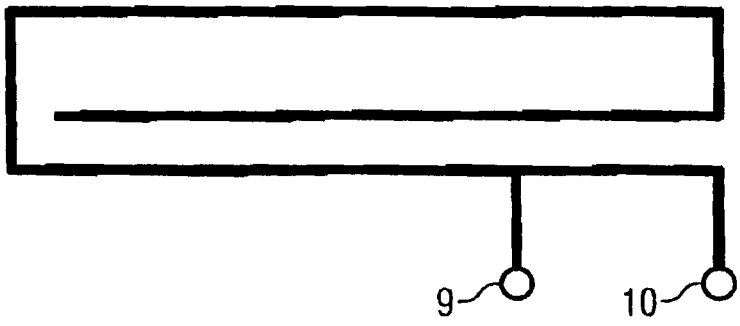
FIG. 6 is still another embodiment of the antenna in accordance with the present invention.

FIGS. 5 and 6 show an embodiment corresponding to the embodiment shown in FIGS. 2 and 4, respectively, but in which the radiating elements are interconnected by means of straight interconnecting parts. A slight space saving is thereby accomplished, without decreasing the antenna performance. A flexible antenna structure is thus provided, enabling different design layouts to be used, for example in dependence on the space available.

The radiating elements 4, 5, 6 of the invention may be manufactured in a most simple way owing to its simple structure, and the conductive pattern, i.e. the radiating elements 4, 5, 6 and the interconnecting parts 7, 8, may form a single, continuous structure. The conductive pattern is preferably substantially planar, but may be arranged on in a non-planar manner. The conductive pattern may for example be etched or printed on the surface of a suitable substrate material, or be embedded in such substrate. The preferred substrate should have low dielectric losses, and exemplary substrates to use include PCB (printed circuit board), ceramic substrates such as HTCC (high temperature co-fired ceramics) or LTCC (low temperature co-fired ceramics), TFT (thin film technology).

Since the antenna structure of the invention enables a substantial antenna size reduction, and also owing to its simple structure, the manufacturing of the antenna is greatly facilitated. The antenna can be made as an element of a printed circuit board and be connected to RF (Radio Frequency) circuitry also comprised on the printed circuit board, or the antenna may even be on-chip integrated with an electronic component (system-on-a-chip, SoC), such as circuitry for radio communication. It can thereby, in both cases, be manufactured in the same process as the RF-circuitry and without substantially increasing the size of the component. The cost of the antenna, and hence of the wireless communication device, may thereby be greatly reduced.

Figure 7:
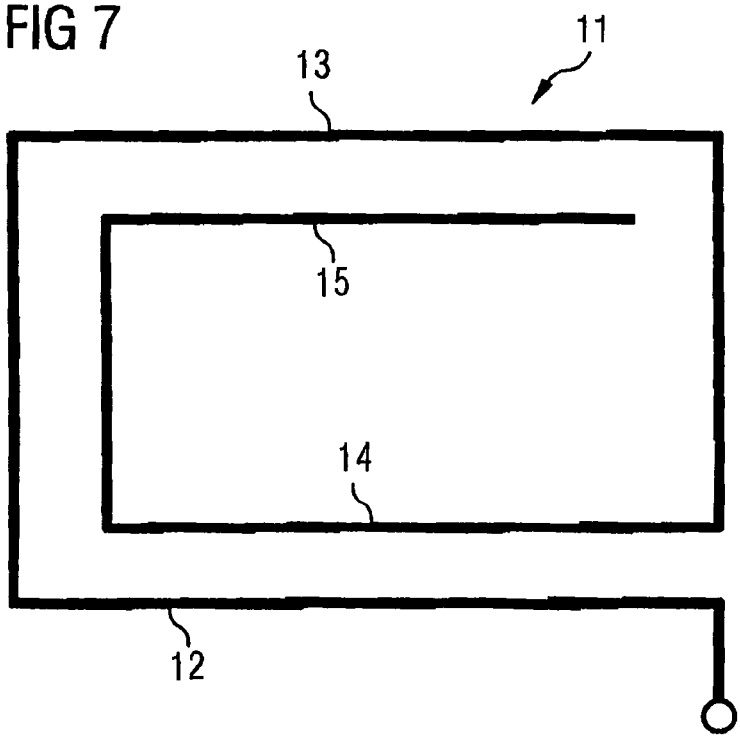
FIG. 7 is yet another embodiment of the antenna in accordance with the present invention.
Figure 8:
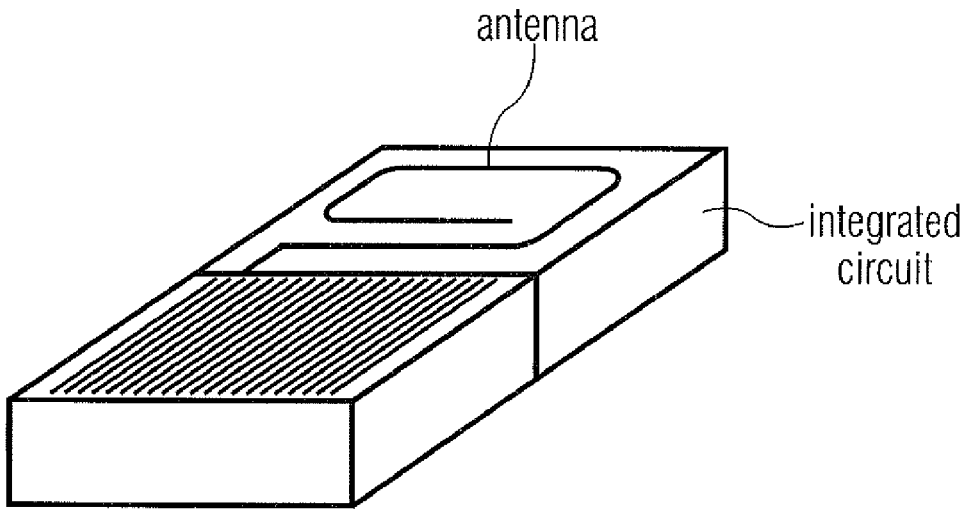

The core of the present invention is the arrangement of the radiating elements of the antenna: in the embodiment three such radiating elements are used. However, the use of a fourth such radiating elements is also contemplated, as is shown in FIG. 7. The antenna structure 11 of this embodiment comprises four radiating elements 12-15. The first radiating element 12 is connected to a second radiating element 13, the second radiating element 13 is connected to a third radiating element 14 and the third radiating element 14 is connected to a fourth radiating element 15. The electromagnetic fields of the first 12 and third 14 radiating elements are interacting constructively, as is the second 13 and fourth 15 radiating elements. The distance between counteracting radiating elements is, in conformity with the previous embodiments, preferably made larger than the distance between constructively interacting elements.

Further, according to another embodiment of the invention any of the above monopole antennas can be combined with any electrical component, such as a capacitor or inductor, for example in order to increase the radiation efficiency.

As was mentioned in the introductory part of the description, a state of the art printed monopole manufactured by printed circuit board techniques renders the physical size of the antenna far too big for wireless communication equipment, in fact many times bigger than the size of the radio component itself. Existing Bluetooth modules are typically about 10×10 mm in size, and a monopole antenna for a Bluetooth application is approximately 30 mm long, and hence the size of the Bluetooth component would be four times as large. In contrast, the monopole antenna structure in accordance with the invention can be made yielding an antenna space requirement of less than 10×3 mm, or expressed in operating wavelength of the antenna: the total physical length of each of the radiating elements can, for some applications, be made approximately ⅛ of the wavelength, or even 1/20 of the wavelength. For a Bluetooth application, the Bluetooth module required would thus have to be made only slightly larger than existing modules, i.e. about 10×13 mm.

Simulations made by the inventors confirm that the radiating elements can be made approximately 1/20 of the antenna's operating wavelength. In Bluetooth applications this translates to a length of each of the radiating elements 4, 5, 6 of approximately 8 mm, or even less than 8 mm. The performance of the proposed antenna structure was simulated using three-dimensional electromagnetic simulation software, and the results were compared to antenna structures mentioned in the introductory part of the present application. The radiation efficiency of the antenna compares favourably to the other structures and comparable performance can be achieved while using a small form factor. Even higher radiation efficiencies than comparable antennas were verified in the simulations. Further, the antenna pattern of the proposed antenna structure yields a radiation pattern similar to a typical dipole antenna, but more isotropic.

In conclusion thus, although the monopole antenna in accordance with the present invention is very short compared to its operating wavelength, the radiation efficiency is still better than comparable antennas. In accordance with the invention thus, the antenna size is minimised while high radiation efficiency is maintained.

In the description the straight radiating elements are described as being essentially parallel. However, "essentially parallel" is intended to include a slight inclination, for example less than 10 degrees. Such deviation may be possible without lessened performance and without requiring a more complicated manufacturing process, for example requiring a higher precision.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A monopole antenna, comprising:

a dielectric substrate;

an antenna feeding point; and an electrically conductive pattern arranged on said dielectric substrate, wherein said conductive pattern comprises a first straight radiating element connected to said antenna feeding point, a second radiating element arranged parallel to, and connected to, said first radiating element, and a third straight radiating element coupled to the second radiating element, the third straight radiating element disposed between and parallel to said first and second radiating elements, and wherein the first, second and third radiating elements are connected such that electric and magnetic fields of said first and said third radiating elements interact constructively, wherein said first and said third radiating elements are spaced apart by a first distance d, and wherein said second and said third radiating elements are spaced apart by a second distance D;

wherein each of said first, second and third radiating elements have substantially the same length which is greater than the sum of said first distance d and said second distance D; and wherein each of said first, second and third radiating elements are interconnected by u-shaped interconnecting parts having a continuous curvature.

2. The monopole antenna as claimed in claim 1, wherein said third radiating element includes an open end of the monopole antenna.

3. The monopole antenna as claimed in claim 1, wherein a length of each of said radiating elements is less than approximately an eighth of an operating wavelength of the antenna, and more than approximately a twentieth of an operating wavelength of the antenna.

4. The monopole antenna as claimed in claim 1, wherein a distance d between said first and third radiating elements is less than a distance D between said second and third radiating elements.

5. The monopole antenna as claimed in claim 1, wherein a distance between said first and third radiating elements is equal to a distance between said second and third radiating elements.

6. The monopole antenna as claimed in claim 1, wherein said first radiating element is further provided with an electrical ground connection.

7. The monopole antenna as claimed in claim 1, wherein said conductive pattern is comprised of a single continuous structure.

8. The monopole antenna as claimed in claim 1, wherein said short-range application is Bluetooth having an operating frequency of approximately 2.45 GHz.

9. The monopole antenna as claimed in claim 8, wherein the length of each of said first, second and third radiating elements is less than approximately 8 mm.

10. The monopole antenna as claimed in claim 8, wherein the antenna is fitted into an area less than approximately 10×3 mm.

11. The monopole antenna as claimed in claim 1, wherein the conducting pattern is substantially planar.

12. An integrated circuit comprising a monopole antenna integrated therein the monopole antenna comprising;

a dielectric substrate;

an antenna feeding point; and an electrically conductive pattern arranged on said dielectric substrate, wherein said conductive pattern comprises a first straight radiating element connected to said antenna feeding point, a second radiating element arranged parallel to, and connected to, said first radiating element, and a third straight radiating element coupled to the second radiating element, the third straight radiating element disposed between and parallel to said first and second radiating elements, and wherein the first, second and third radiating elements are connected such that electric and magnetic fields of said first and said third radiating elements interact constructively, wherein said first and said third radiating elements are spaced apart by a first distance d, and wherein said second and said third radiating elements are spaced apart by a second distance D;

wherein each of said first, second and third radiating elements have substantially the same length which is greater than the sum of said first distance d and said second distance D; and wherein each of said first, second and third radiating elements are interconnected by u-shaped interconnecting parts having a continuous curvature.

13. The integrated circuit as claimed in claim 12, wherein said circuit is one of: a transceiver circuit, a receiver circuit and a transmitter circuit.

14. A method for manufacturing a monopole antenna comprising an electrically conductive pattern arranged on a dielectric substrate, the method comprising:

arranging a first straight radiating element on said dielectric substrate, connecting said first radiating element to an antenna feeding point, arranging a second straight radiating element parallel to said first radiating element, interconnecting said second radiating element to the first radiating element, arranging a third straight radiating element between said first and second radiating elements parallel to both of said first and second radiating elements at a first distance d to said first straight radiation, and at a second distance D to said second straight radiation, and interconnecting said third radiating element to said second radiating element, wherein electric and magnetic fields of said first and said third radiating elements interact constructively, wherein each of said first, second and third radiating elements have substantially the same length which is greater than the sum of said first distance d and said second distance D; and wherein each of said first, second and third radiating elements are interconnected by u-shaped interconnecting parts having a continuous curvature.

15. The method as claimed in claim 14, wherein arranging the third straight radiating element further comprises arranging the third straight radiating element to include an open end of the monopole antenna.

16. The method as claimed in claim 14, wherein a length of each of said radiating elements is less than approximately an eighth of an operating wavelength of the antenna, and more than approximately a twentieth of an operating wavelength of the antenna.

17. The method as claimed in claim 14, wherein arranging the third straight radiating element further comprises arranging the third straight radiating element such that a distance d between said first and third radiating elements is less than a distance D between said second and third radiating elements.

* * * * *